US005899816A

United States Patent [19]

Pearson

[11] Patent Number: 5,899,816

[45] Date of Patent: May 4, 1999

[54] GOLF CLUB PRACTICE DEVICE

[76] Inventor: Taylor Pearson, 2165 Seaview, Morro Bay, Calif. 93442

[21] Appl. No.: 08/929,361

[22] Filed: Sep. 9, 1997

Related U.S. Application Data

[62] Division of application No. 08/599,935, Feb. 14, 1996, Pat. No. 5,720,669

[60] Provisional application No. 60/008,308, Dec. 7, 1995.

[51] Int. Cl.[6] ..... A63B 69/36

[52] U.S. Cl. ..... 473/265; 473/268

[58] Field of Search ..... 473/265, 257, 473/258, 260, 261, 264, 266, 268

[56] References Cited

U.S. PATENT DOCUMENTS

| | | | |
|---|---|---|---|
| 3,848,873 | 11/1974 | Linning . | |
| 5,375,833 | 12/1994 | Marier . | |
| 5,720,669 | 2/1998 | Pearson | 473/265 |

*Primary Examiner*—George J. Marlo
*Attorney, Agent, or Firm*—Coudert Brothers

[57] ABSTRACT

A golf club practice device consisting of:

a generally planar base from which a positioned golf ball may be driven;

a supporting member in a first plane extending vertically from the surface of the generally planar base at a distance of eleven to fourteen inches, and having a first end and a second end connected to the planar base;

an elongated member in a second plane substantially parallel to the generally planar base, having a length of 30 inches to four feet, and having a first end and a second end distal said supporting member; and a connecting member in the same plane as the elongated member, between the first end of the supporting member and the first end of the elongated member, substantially parallel to the generally planar base, having an elbow connection to each of the first ends, substantially perpendicular to the supporting member and the elongated member, and having a length of four to eight inches;

wherein the supporting member, the elongated member and the connecting member form a single one piece construction; and wherein the connecting member is over a golf club head when the club head is addressing a golf ball on the surface of the generally planar base directly under a location on the connecting member as a user starts a practice golf swing that is a critical distance from the elbow connection of the connecting member to the first end of the supporting member and between the first ends of the elongated member and the supporting member so that the golf ball would just be completely visible to the user and wherein the elongated member is substantially parallel to the user's body as the user faces the practice device and serves as a guide for the user to achieve an optimum golf swing in which the golf club is brought back in the direction of the second end of the elongated member and an optimum golf swing is achieved when no part of the device is struck during a complete golf swing.

7 Claims, 5 Drawing Sheets

GOLF CLUB PRACTICE DEVICE

This is a division of application Ser. No. 08/599,935 filed Feb. 14, 1996 U.S. Pat. No. 5,720,669.

This application claims the benefit of prior U.S. provisional application Serial No. 60/008,308, filed Dec. 7, 1995.

FIELD OF THE INVENTION

The present invention relates generally to the field of golf club training devices. More specifically, the invention is directed to a golf club practice device for use in developing a smooth swing by alerting the golfer when the golf club is not within the normal swing plane.

BACKGROUND OF THE INVENTION

Many golf club training devices have been developed over the years. For example, U.S. Pat. No. 3,848,873 discloses and claims a lightweight indicator which is mounted on a golf club to give the golfer an indication of the lack of swing smoothness. The device produces an audible signal when the golfer has exceeded the optimum acceleration of the club. U.S. Pat. No. 3,848,873 disclosed and claims a light emitter diode assembly to be mounted on the shaft of a golf club for use with the Selective Electronic Company's trademarked Seispot system for analyzing a golfer's swing.

There is a need for a non-complex golf club practice device which will alert the golfer when the golf club is taken outside the normal swing plane. There is a need for such a device which will train the golfer to avoid slices, hooks, topping the golf ball and other swing imperfections as well as to teach the golfer to avoid "looking up."

SUMMARY OF THE INVENTION

The golf swing guide device of the present invention includes a supporting member, an elongated member and a connecting member. The supporting member comprises a shaft or tube having one end connected to a first end of the connecting member and the other end extending vertically from a stationary base. For example, the other end is capable of being driven into the ground, fixed to the golf swing practice area or otherwise supported on a practice surface. It is contemplated that in addition to the surface of a back yard, park or golf driving range, the practice surface may include the floor of a room, garage, porch and the like. The elongated member has one end connected to the end of the connecting member distal to the first end of the connecting member.

Preferably, the supporting member is in a first plane substantially perpendicular to the surface of the practice area and extends a vertical distance from the surface of the practice area. A typical vertical distance is about eleven to about fourteen inches. Preferably, the connecting member is in a second plane substantially perpendicular to the vertical axis or first plane of the supporting member and extends a horizontal distance from its connection with the supporting member. A typical horizontal distance is about four to about eight inches. Preferably the elongated member is substantially perpendicular to the connecting member and extends a horizontal distance in the same plane from its connection with the connecting member. Preferably the length of the elongated member is at least about 30 inches. Still, more preferably, this length is about 30 to about 34 inches so that the elongated member does not interfere with an optimum golf swing as will be described in greater detail below. The maximum length of the elongated member is about four feet. If the elongated member were more than four feet, the guide device would not only interfere with the optimum golf swing, but the device would tend to lack sufficient stability to remain in an upright position with the horizontal axis of the elongated member being substantially parallel to the practice surface.

The device can be of one integral piece having one end of the vertical supporting member affixed to the surface of the practice area, a connecting member and elongated shaft extending parallel to the practice surface, and a free end opposite the affixed end. Preferably, the device is manufactured with a plurality of interconnecting pieces, i.e., from two pieces to six pieces, as described in more detail below.

The device of the present invention is used by strategically placing a practice ball or golf ball on the practice surface at a critical distance of about four inches from the connection between the connecting member and the supporting member and directly under the elongated connecting member. The user assumes a proper golf stance, faces the device with the user's body substantially parallel to the elongated member and properly grips the golf club in preparation of taking a practice swing at the ball. In a proper stance, the complete golf ball should just be visible to the line of sight of the user. If the user is too close to the ball, the top of the connecting member at least partially obscures the view of the ball. If the user is too far from the ball, a portion of the practice surface is visible between the ball and the top of the connecting member. The optimum distance is achieved when the user moves from a position where the ball is partially visible to the position where the ball just becomes completely visible. The device of the present invention can be effective in perfecting a user's swing without use of a golf ball by simply taking a practice swing at an imaginary golf ball.

In an optimum practice swing, no contact is made between the shaft of the golf club and the elongated member. After the user has reached the top of the back stroke and during the downstroke, there is a tendency for a typical weekend golfer to take the club out of the same plane as the back stroke. If the user swings from "outside in," the golf ball tends to slice. If the user swings from "inside out," the golf ball tends to hook. In either event, the shaft or head of the club will strike some portion of the swing guide device. This will very dramatically alert the user to the violation of the optimum swing plane. The user places the ball in a position designated on the device as being under the connecting member. As a result, the ball will be struck within the sweet spot on the face of the club head if the user has not violated the optimum swing plane. Therefore, another advantage of the present device is to teach the golfer to avoid "topping" the ball. If the user's eyes are not kept on the ball during the entire swing process, the user will violate the normal swing plane and strike the device rather than the ball. Repeated practice with the swing guide device will allow the user to develop a habit of using an optimum swing.

Each of the foregoing features of this device will be more fully described below with reference to the following set of drawings.

DETAILED DESCRIPTION OF THE PRESENT INVENTION

Figure 1:
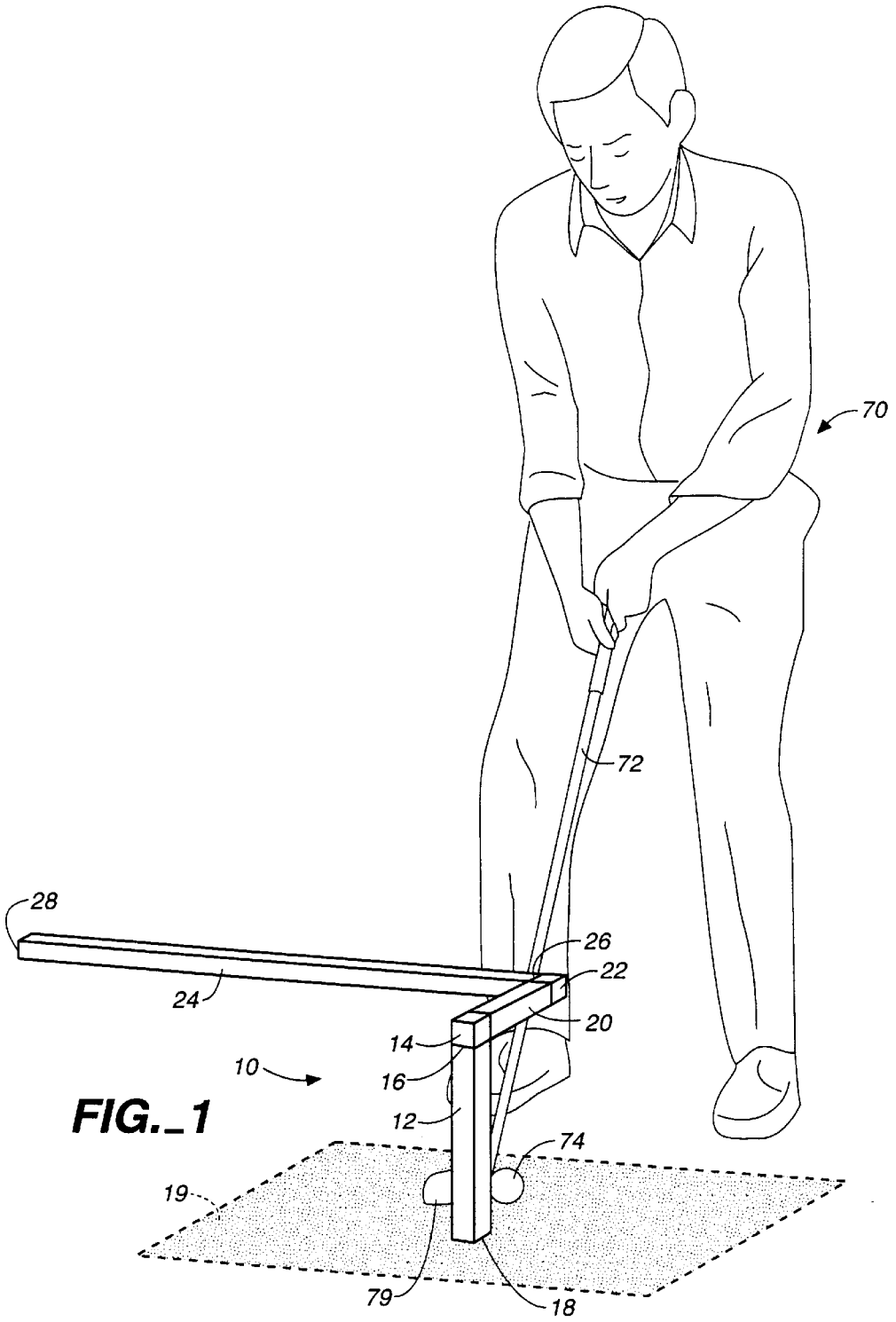
FIG. 1 is a perspective view showing the top, back and one end of one embodiment of the device of the present invention showing a user with the proper stance addressing a golf ball.
Figures 2, 2A:
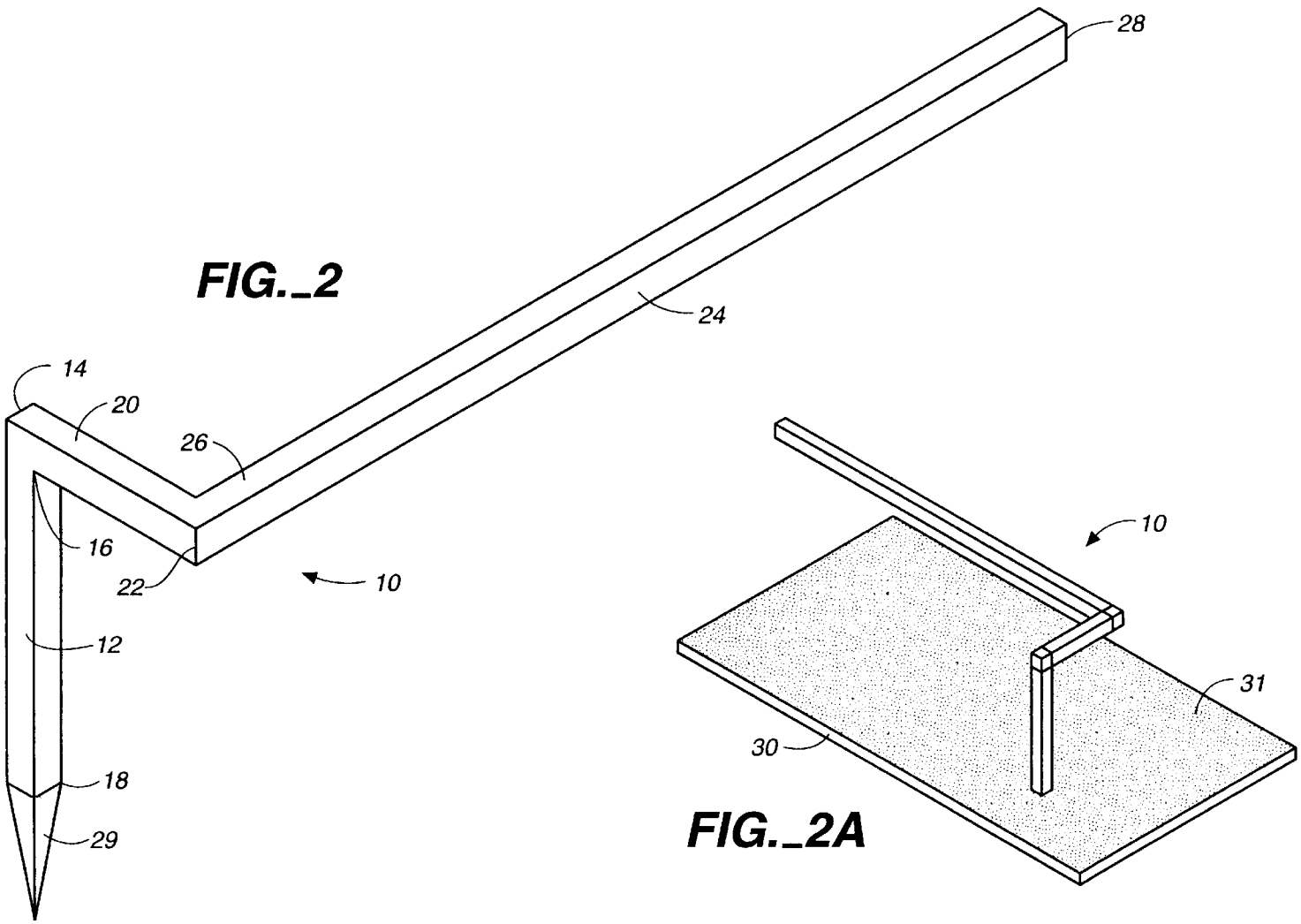
FIG. 2 is a perspective view showing the top, front and one end of a unitary design of the device of the present invention for placement in turf.
FIG. 2A is an embodiment of the present invention positioned on a mounting plate covered with artificial turf.

FIGS. 1 and 2 show a golf club practice device 10 having supporting member 12, elbow 14 at end 16 opposite end 18 extending vertically from stationary base 19, connecting member 20 between elbow 14 and elbow 22 and elongated member 24 extending from elbow 22 connected at end 26 to free end 28 so that it is substantially parallel to the surface of the practice area. Device 10 can be made from hollow tubing having a square cross-section as shown. It is apparent to one skilled in the art that the cross-section is not critical and can have a range from three-sided to circular. The materials of construction of the device of the provisional application can be metal, wood, plastic or combinations of such materials. It is preferred that device 10 be hollow plastic tubing to prevent any harm to a golfer's club coming into contact with device 10 during an improper swing. FIG. 2 shows device 10 as a unitary design with end 18 having tapered spike 29 for being driven into the ground. FIG. 2A shows device 10 positioned on plate 30, e.g., a steel plate, covered with artificial turf 31.

Referring now to FIGS. 3 and 6–10, six-piece swing guide device 32 is shown with supporting stake 33 having spike end 34 and recessed end 36; support member 38 having hollow first end 40 capable of receiving recessed or fluted end 36 and hollow second end 42; connecting elbow 44 having first recessed or fluted end 46 for joining with second end 42 and second recessed or fluted end 48; connecting member 50 having hollow first end 52 for receiving second recessed or fluted end 48 and hollow second end 54; connecting elbow 56 having first recessed end 58 for joining with second recessed end 54, and second recessed end 60; and elongated member 62 having hollow first end 64 for joining second recessed end 60 and free end 66.

Each of the fluted or recessed ends of elbows 44 and 56 and recessed or fluted end 36 of supporting stake 32 is designed to have a snug fit with a corresponding end of one of the members of the present device. In the event the user were to strike a portion of any of the members, at least one of the recessed ends disengage from the corresponding end of the struck member. This will prevent injury to the golf club coming into contact with such a member. Accordingly, the materials of construction for a six-piece device can be solid metal, wood, plastic, or combinations thereof. It is apparent that if a solid member were used, each of its ends would be hollow to receive the corresponding recessed end of elbows 44 and 56 and stake 33. One example of a suitable material for the six-piece device would be aluminum or other lightweight metal. Each of the members that could come into contact with a golf club during an improper swing should be covered with a thin plastic or other resilient coating to prevent scratching of the golf club.

Figures 3, 3A:
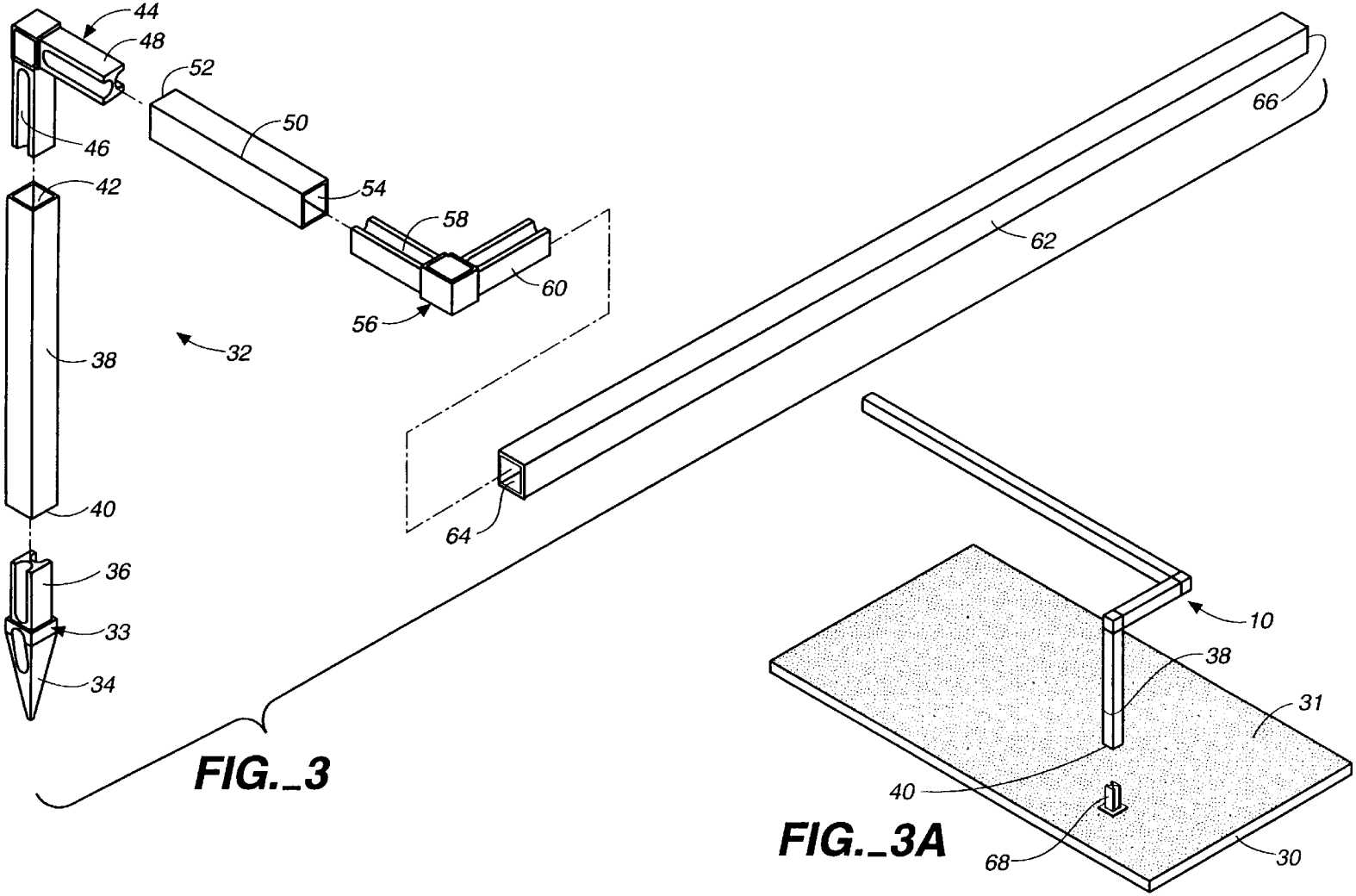
FIG. 3 is an exploded perspective view showing the top, front and one end of a six-piece embodiment of the device of the present invention for placement in turf.
Figure 4A:
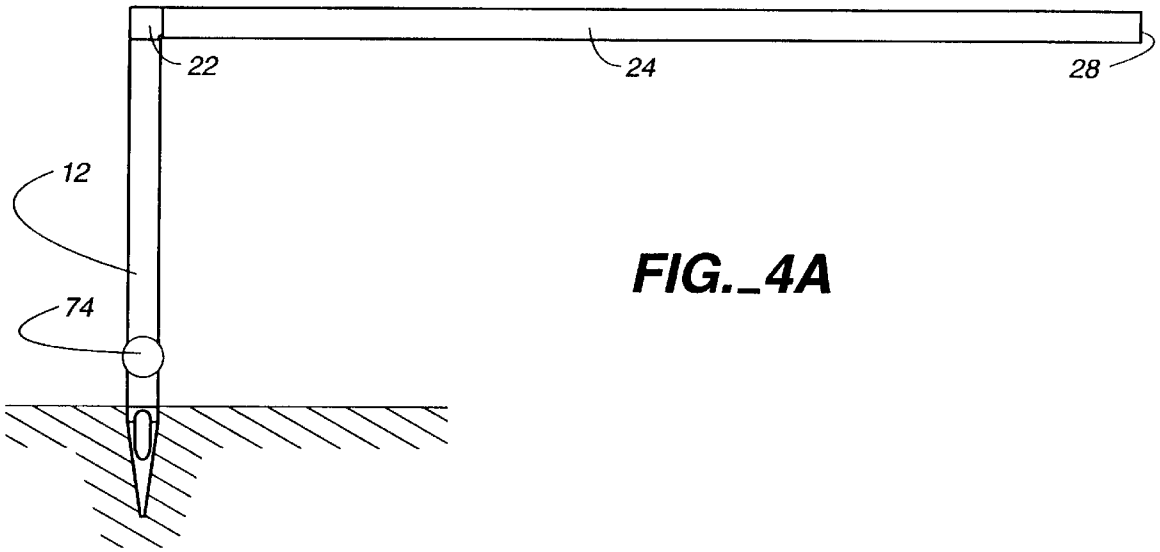
FIG. 4A is a front view of the device of FIG. 3 supported on the practice surface and a golf ball teed up for use with the device.
Figure 4:
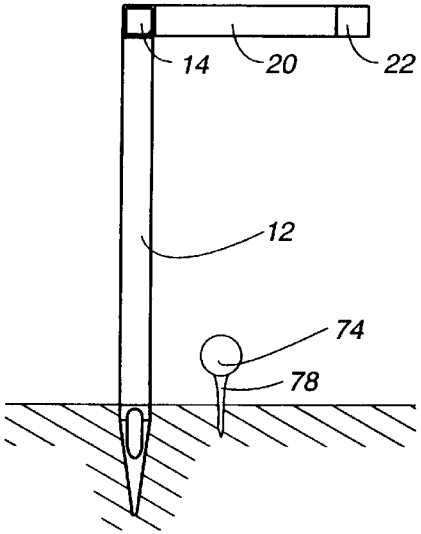
FIG. 4 is an end view of the device of FIG. 3 supported on the practice surface and a golf ball teed up for use with the device.
Figure 5:
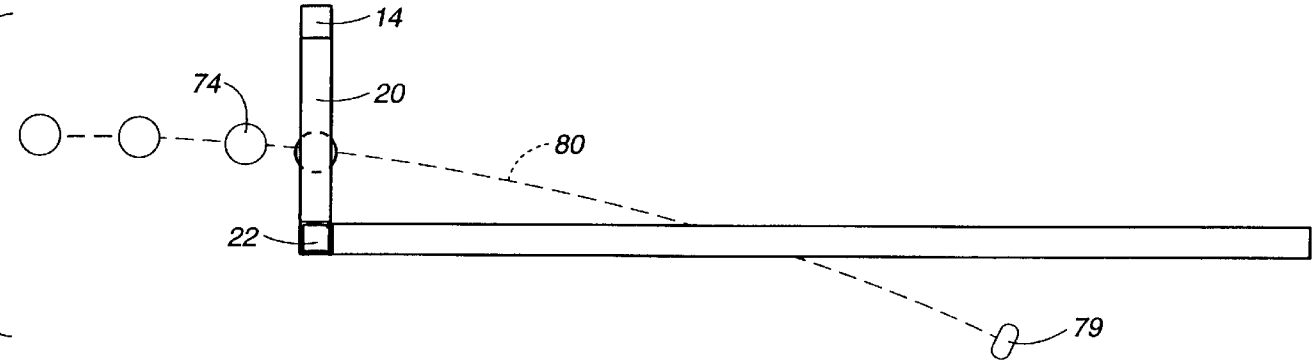
FIG. 5 is a top view of the device of FIG. 3 and a representation of a golf club head following through during the optimum golf club swing plane and the path the ball will take immediately after being struck.
Figure 6:
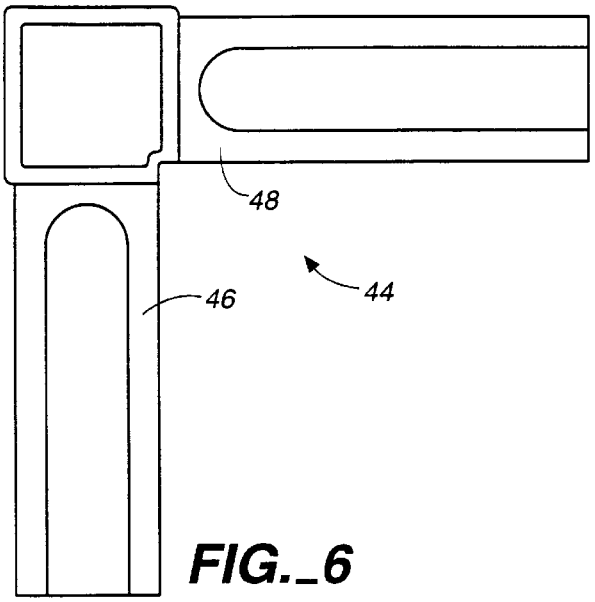
FIG. 6 is a fluted side view of a connecting elbow of the device of FIG. 3.
Figure 7:
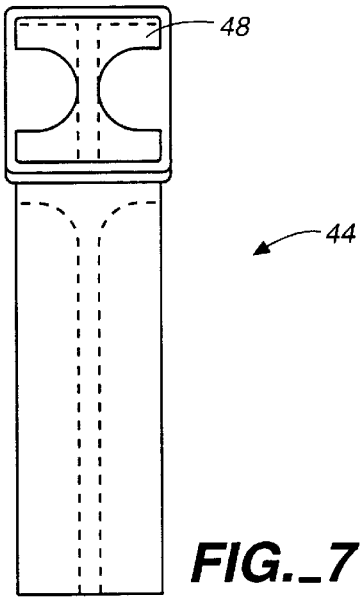
FIG. 7 is an end view of the connecting elbow of FIG. 6.

In FIG. 3A, in place of stake of spike 33 for affixing the device of the present invention to the stationary base or practice surface, recessed or fluted projection 68 was welded to steel plate 30 and was used to support device 10. Projection 68 was placed through a square hole in synthetic or artificial turf mat 31 and mat 31 was placed over plate 30. End 40 of support member 38 was joined to projection 86 and device 10 was ready for use as shown in FIG. 1. A pin (not shown) was inserted through mat 31 into plate 30 and was used along with projection 68 to maintain mat 31 in its desired position during use of device 10.

Figure 9:
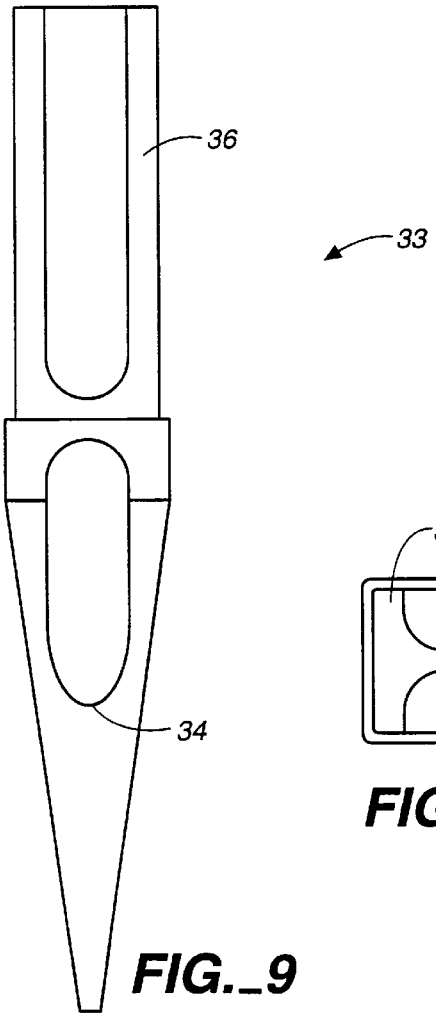
FIG. 9 is a side view of the fluted side of the stake of the supporting member of FIG. 8.
Figure 8:
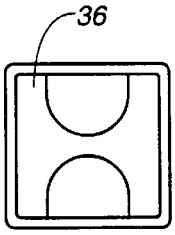
FIG. 8 is a top view of a stake of the supporting member of the device of FIG. 3.
Figure 10:
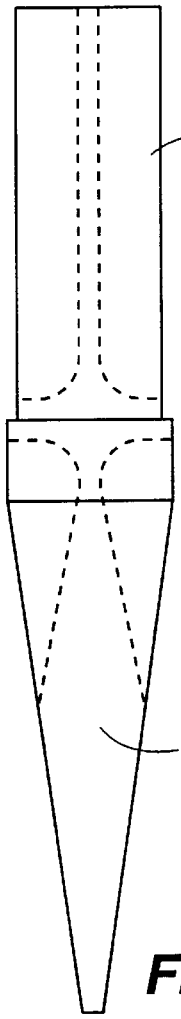
FIG. 10 is a end view of the stake of the supporting member of FIG. 8.

FIG. 3 shows the dissembled six pieces that were made for assembly to a preferred embodiment of the present device. Members 38, 50 and 62 were made from one inch square plastic hollow tubing having a wall thickness of 0.045 inch. The length from first end 40 to second end 42 of supporting member 38 was 11 inches. The length from first end 52 to second end 54 of connecting member 50 was 6 inches. The length from first end 64 to free end 66 of elongated member 62 was 32 inches. Elbows 44 and 56 and stake 33 were made from a solid piece of injection molded plastic. Stake 33 had a cross-section of one inch square and a total length of six inches. Recessed end 36 of stake 33 had a length of 2.5 inches and had an 0.889 inch square cross-section. Recessed end 36 had a pair of sidewalls with ½ inch diameter flutes and a pair of sidewalls without flutes as shown in FIG. 10 for ease in joining hollow supporting member 38. Spike 34 had a pair of tapered sidewalls with ½ inch diameter flutes and a pair of tapered sidewalls without flutes that slope inward 0.04375 inch over a total spike length of three inches as shown in FIGS. 9 and 10. All interior and exterior corners of elbows 44 and 56 and stake 33 were ⅛ inch. The length of each of the recessed ends 46, 48, 58 and 60 of elbows 44 and 56 was 2.5 inches and had a 0.8 inch square cross-section and each of the recessed sides had the same type of fluted and non-fluted sidewalls as the recess of end 36 of stake 33 as shown in FIGS. 6–9. The remaining portion of each of the elbows had a length, a width of 1.125 inches and a thickness of 1 inch.

In FIGS. 1, 4, 4A and 5, a golfer 70 held golf club 72 addressing golf ball 74 on tee 78 (shown in FIG. 4) in synthetic grass mat 19 four inches from support member 12 and directly under connecting member 20. The eyes of golfer 70 were in direct line with the entire circumference of ball 74 so that elbow 22 appeared to just touch a point of the ball's circumference. Golfer 70 brought club head 79 of club 72 along path 80 (shown in FIG. 5) and after reaching the top of the back swing, golfer 70 maintained head 79 on the inside line along the same path 80 until ball 74 was struck. At times when golfer 70 did not maintain path 80, club head 79 struck elongated member 24 at elbow 22 or the shaft of club 72 struck elongated member 24 or other part of the device which caused an immediate uncoupling. Frequent practice with the device of the present preliminary application enables one to greatly improve one's golf swing.

The device of the present invention can be affixed to the practice surface in a variety of ways in addition to the ways mentioned above. For example, a small lead plate can be used in place of the steel plate to which the projection can be fastened. All such modifications and variations of the device of the present invention are properly, and intended to be, within the full range of equivalents of the following claims.

What is claimed is:

1. A golf club practice device consisting of:

a generally planar base from which a positioned golf ball may be driven;

a supporting member in a first plane extending vertically from the surface of said generally planar base at a distance of eleven to fourteen inches, and having a first end and a second end connected to said generally planar base;

an elongated member in a second plane substantially parallel to said generally planar base, having a length of 30 inches to four feet, and having a first end and a second end distal said supporting member; and a connecting member in the same plane as said elongated member, between said first end of said supporting member and said first end of said elongated member, substantially parallel to said generally planar base, having an elbow connection to each of said first ends, substantially perpendicular to said supporting member and said elongated member, and having a length of four to eight inches;

wherein said supporting member, said elongated member and said connecting member form a single one piece construction; and wherein said connecting member is over a golf club head when said club head is addressing a golf ball on the surface of said generally planar base directly under a location on said connecting member as a user starts a practice golf swing that is a critical distance from the elbow connection of said connecting member to said first end of said supporting member and between said first ends of said elongated member and said supporting member so that the golf ball would just be completely visible to the user and wherein said elongated member is substantially parallel to the user's body as the user faces the practice device and serves as a guide for the user to achieve an optimum golf swing in which the golf club is brought back in the direction of said second end of said elongated member and an optimum golf swing is achieved when no part of the device is struck during a complete golf swing.

2. The device of claim 1 wherein said device comprises plastic.

3. The device of claim 1 wherein said substantially planar base is a golf practice area and wherein said second end of said supporting member is capable of being driven into the ground of the golf practice area.

4. The device of claim 3 wherein said second end of said supporting member is capable of receiving a stake and wherein said stake has a first end capable of being driven into the ground of the golf practice area during use and a second end connected to said second end of said supporting member.

5. The device of claim 1 wherein said generally planar base is a plate.

6. The device of claim 5 wherein said plate is covered with a mat of a synthetic material so that the user begins a practice swing with the golf club head on said mat.

7. The device of claim 6 wherein said mat is artificial turf.

* * * * *